United States Patent [19]

Foster

[11] 4,116,287

[45] Sep. 26, 1978

[54] WELL DRILLING ASSEMBLY AND METHOD

[76] Inventor: Howard E. Foster, 932 St. Joseph Ave., Los Altos, Calif. 94022

[21] Appl. No.: 809,182

[22] Filed: Jun. 23, 1977

[51] Int. Cl.[2] ..... E21B 21/00

[52] U.S. Cl. ..... 175/65; 175/219; 24/263 B; 81/57.16; 173/167; 173/164; 173/57

[58] Field of Search ..... 175/170; 175/65, 40, 175/18, 170, 219, 220, 209, 210, 85, 52; 173/90, 163, 164, 167, 30, 57; 24/263 B, 263 D, 263 DA, 263 DB, 263 DC; 81/57.15, 57.16, 57.34

[56] References Cited

U.S. PATENT DOCUMENTS

| | | | |
|---|---|---|---|
| 2,633,333 | 3/1953 | Storm | 175/170 X |
| 2,728,555 | 12/1955 | Burg et al. | 175/57 X |
| 2,964,115 | 12/1960 | Clatfelter | 175/170 X |
| 3,331,585 | 7/1967 | Dubberke | 175/85 X |
| 3,774,556 | 11/1973 | Poll | 175/170 X |
| 3,799,009 | 3/1974 | Guier | 81/57.16 |

*Primary Examiner*—Ernest R. Purser
*Assistant Examiner*—Nick A. Nichols, Jr.
*Attorney, Agent, or Firm*—Flehr, Hohbach, Test, Albritton & Herbert

[57] ABSTRACT

A well drilling assembly including a platform adapted to support a person while drilling a well therebeneath through an opening in the platform includes a clamp assembly carried by the platform and mounted for rotation with respect thereto. The clamp assembly includes a pair of open jaws disposed in confronting relatively movable relation and with respect to each other for engaging and for readily releasing a drilling stem so as to be able to support a column of drilling sections as new sections are added and also to permit the clamp to rotate while the drilling sections are rotated at a position supported by the clamp to hold the sections in spaced relation from the bottom of the hole being drilled. The method of drilling includes manipulations involved in supporting the sections of pipe spaced from the bottom of the drilled hole while flooding water through the pipe to flush out the opening and also to permit the pipe to be rotatably driven while so held without exerting manual lifting force on the pipe. The clamp assembly is readily released from the pipe so as to lower the sections into engagement with the bottom of the hole being drilled and the like.

6 Claims, 4 Drawing Figures

WELL DRILLING ASSEMBLY AND METHOD

BACKGROUND OF THE INVENTION

This invention pertains to a well drilling assembly and method and more particularly to improved clamping means for supporting a length of drilling sections of pipe while manipulating the drilling sections.

Heretofore, in well drilling operations using a bit applied to an end of a first section of pipe while rotating the pipe to drill a hole into the earth, a sequence of pipe sections are added so that the combined group of sections will rotate together further and further into the earth. In order to drive the pipe, according to one arrangement, a hand-held motor is coupled to the top of the pipe. As each short section (on the order of five feet) enters the ground the motor must be de-coupled from the uppermost section and a subsequent section of pipe connected. At that point, the top end of the outermost end of pipe is disposed at least five feet above the ground while efforts are made to connect the motor to the upper end of the newly added pipe section.

An alternative arrangement is to first couple the newly added pipe section to the motor and then to couple the lower end of the newly added section to the upper end of the pipe column. In either event it is necessary to manhandle a relatively heavy motor up in the air at least shoulder high or better and this becomes quite tiresome in the course of a day's drilling. Also, at this time it is necessary to hold the drilling sections spaced from the bottom of the drilled hole.

Further, drilling of the kind described involves further problems such as insuring against the binding action of the earth about the pipe as the pipe stops rotating. Accordingly, it has been found useful to lift the pipe column upwardly somewhat out of the hole in order to keep the bottom section from becoming locked in the material in the hole. Lifting the pipe upwardly adds further to the height to which the motor must be lifted in order to couple it to the top of the newly added section.

SUMMARY OF THE INVENTION AND OBJECTS

In general there is provided for a well drilling assembly of the type employing a platform having an opening for passing a drillstem therethrough and adapted to support a person while drilling a well therebeneath, a clamp assembly supported and carried by the platform. The clamp assembly includes a mounting plate, first and second open opposed jaws carried by the mounting plate and disposed above the opening being drilled. Means supporting one of the jaws to move between advanced and retracted positions relative to the other and to lock in its advanced position serves to clamp a pipestem between the jaws. Finally, mounting means serve to support the plate to rotate around the axis of, and with, the clamped pipestem. The means for locking the jaws together includes a readily releasable foot-operated means whereby as the pipe and clamping assembly rotate together slowly during the commencement of successive stages of drilling the clamp can be readily disengaged from the pipe by a person's foot.

In general, it is an object of the present invention to provide an improved well drilling assembly and method.

A further object of the present invention is to provide an improved well drilling assembly characterized by an improved clamping mechanism serving to support the pipe from above at different steps in the drilling operation.

The foregoing and other objects of the invention will become more readily evident from the following description of a preferred embodiment when considered in conjunction with the drawings.

DETAILED DESCRIPTION OF A PREFERRED EMBODIMENT

Figure 1:
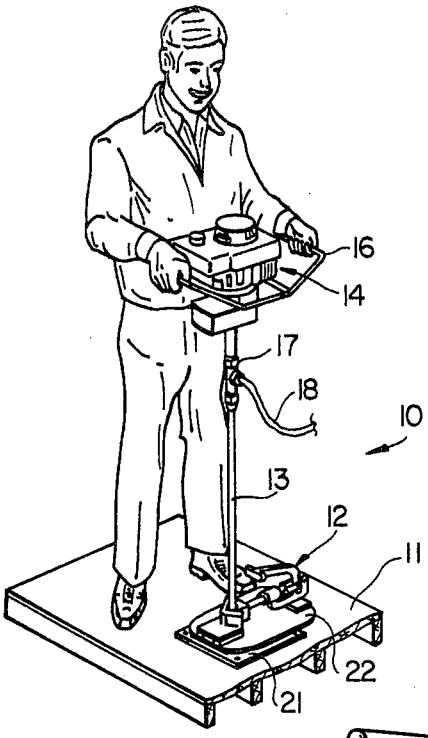
FIG. 1 shows a diagramatic perspective view of a well drilling assembly according to the invention and shown in operation.
Figure 2:
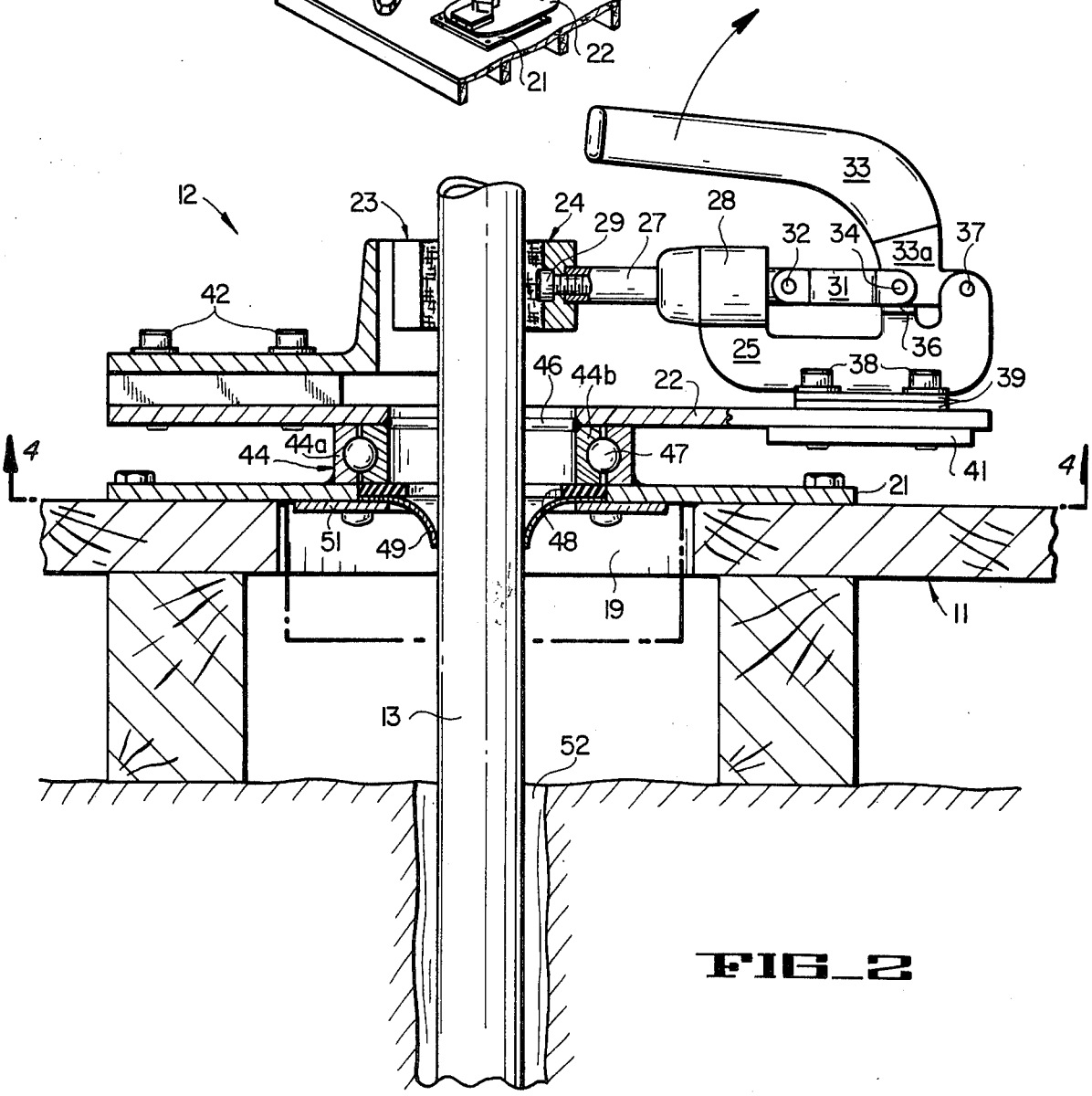
FIG. 2 shows an elevation view mostly in section of a well drilling assembly according to the invention.

A drilling assembly 10 as shown in FIG. 1 includes, in general, a support platform 11, a clamping assembly 12 for readily engaging and disengaging sections of pipe 13, and a rotational power source or motor 14 as may be equipped with handles 16 for manipulating same.

In addition, and as shown in FIG. 1 a hose connection of known style 17 serves to continuously couple a supply of water via the water hose 18 to the interior of a rotating pipe section 13 without wrapping hose 18 around the pipe section.

Platform 11 includes an access opening 19 through which drilling is accomplished. Clamping assembly 12 is supported by platform 11 by means of the transversely extending stationary plate 21, also formed with an opening 15 centrally thereof.

Figure 3:
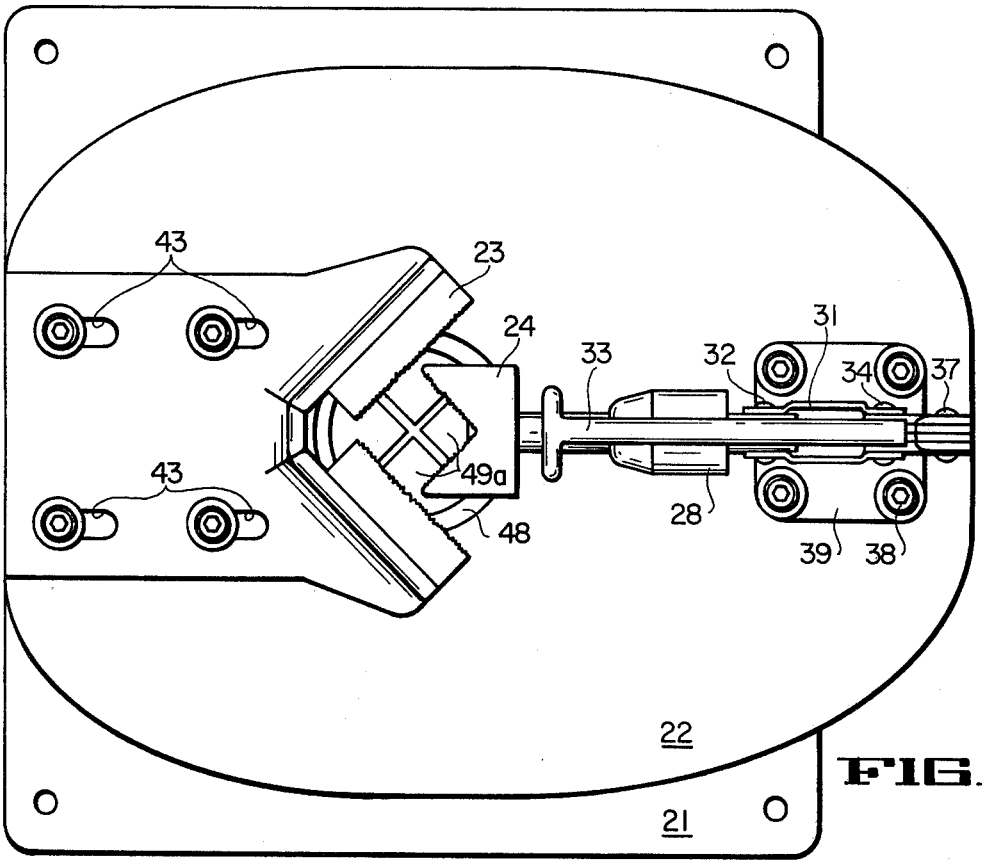
FIG. 3 shows a top plan view of the clamping assembly shown in FIG. 2.
Figure 4:
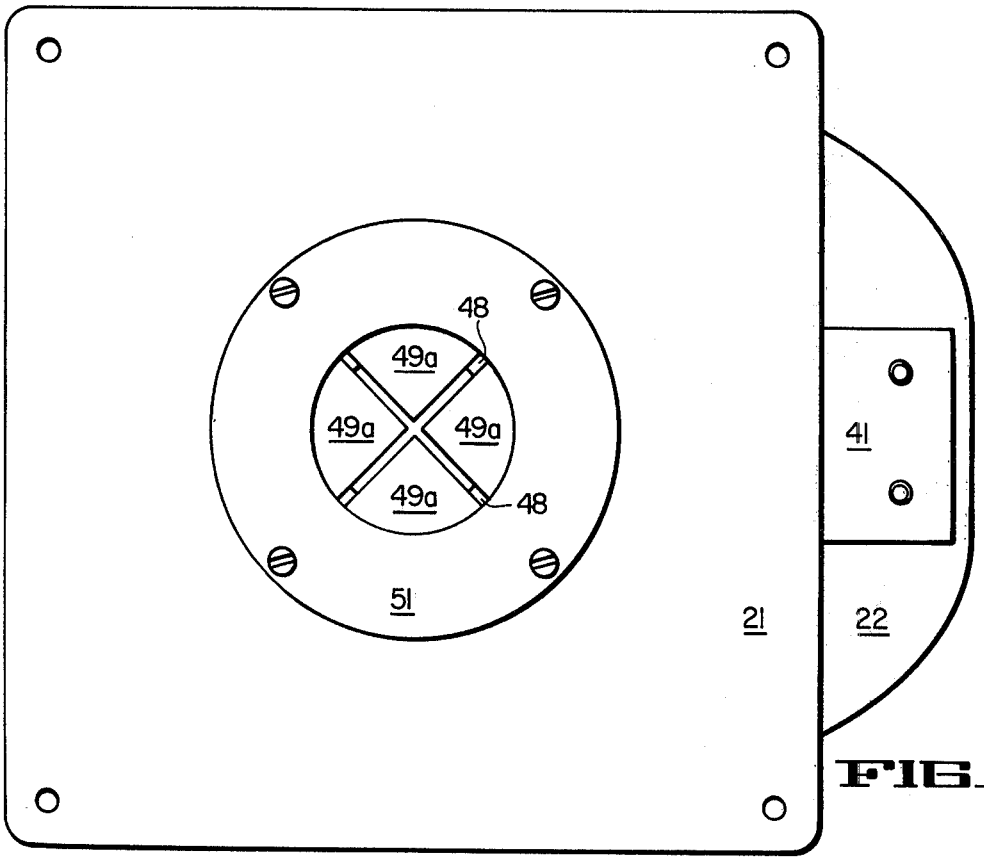
FIG. 4 shows a bottom plan view of the clamping assembly as shown in FIG. 3 taken along the line 4—4 of FIG. 2 with the drilling pipe removed for clarity.

Clamping assembly 12 inclues a mounting plate 22 for carrying a stationary open jaw 23 in opposed relation to a movable open jaw 24. As shown in FIG. 3, jaws 23, 24 are disposed above opening 19 in opposed confronting relation.

Means supporting jaw 24 to move between advanced and retracted positions relative to jaw 23 and to lock in its advanced position for clamping firmly onto pipestem 13 comprises a connecting link 27 for movement between advanced and retracted positions in a busing 28 supported by the body 25. An end of link 27 is coupled by means of the threaded stud 29 to jaw 24 while an over-center link 31 is pivotably coupled at its opposite ends to link 27 at pivot 32 and to a reduced portion **33*a* of a trip or releasing lever 33 at pivot 34. Lever 33 or trip is foot operated and is arranged to be raised upwardly from the fixed stop 36 about a pivot axis 37**.

Means adjustably disposing jaw 24 radially with respect to pipestem 13 varies the degree to which jaw 24 can advance into engagement with pipe 13 and includes the releasable studs 38 which pass downwardly through slots not shown in both the base 39 of body 25 and through mounting plate 22 to threadedly engage retaining plate 41. Similarly jaw 23 is releaseably adjustable to be retained by studs 42 tightened downwardly through the slots 43 formed in the trailing portion of jaw 23.

Mounting means supporting plate 22 to rotate around the axis of and with the clamped pipe 13 includes the bearings 44 having an outer race **44*a* welded to the top of plate 21 and an inner race 44*b* welded as at 46 to join plate 22 thereto. The ball bearings 47** are disposed between the inner and outer races.

Means forming a seal beneath bearings 44 to provide protection against intrusion of damaging foreign particles into bearings 44 comprises an annular seal 48 of resilient material and a circular resilient closure 49. Both seal 48 and closure 49 are disposed to fit within the central opening 15 of plate 21 beneath bearings 44 and to be retained tightly in place by means of the annular retaining plate 51.

Closure 49 includes a pair of perpendicular slots therethrough so as to form independantly resilient pad quadrants 49*a*.

In operation with a first section of pipestem such as 13 coupled to motor 14, section 13 is rotated to drill directly into the earth forming the opening 52. After section 13 has been drilled downwardly substantially to the top of jaws 23, 24, section 13 is then lifted upwardly out of the bottom of the hole to some limited degree, clamping assembly 12 is secured to pipe section 13, then both clamping assembly 12 and pipe section 13 are rotated while supplying water via coupling 17 to flush out the drilled hole 52. At this point it will be appreciated that it is not necessary for the operator to expend manual force in holding pipe section 13 spaced from the bottom end of hole 52 while the hole is being flushed out. Also it is not necessary to manually support the drill motor.

Next section 13 is disposed two to four inches above the bottom of hole 52 and clamping assembly 12 is again engaged with the upper end of pipe section 13 so as to maintain it in a fixed vertical position while a second pipe section is connected to the upper end thereof. This is conventionally done by providing female threads on the upper end of the lower pipe section and male screws on the upper pipe section.

From the foregoing it will be readily evident that there is pursued a method of drilling a well through an access opening and a drill platform using a handheld rotational power source for rotating a plurality of drillstem sections coupled in tandem comprising the steps of coupling the power source to the upper end of a first section of drillstem. The next steps include rotating the first section while supplying liquid under pressure therethrough to drill the first section into the ground followed by lifting the first section upwardly clear of the bottom of the drill hole. Subsequently, steps are pursued of applying the clamp carried by the platform to grip the first section for holding the first section in its lifted position while rotating the clamp and the pipe section together while carried by the platform and then supplying liquid via the pipe section to flush the drilled hole.

The method further includes the steps of disconnecting the first section from the power source and connecting a second section to the first section, rotating the clamp assembly and the first and second sections together while flushing liquid into and out of the drilled hole followed by unclamping the clamp assembly to permit the first and second sections to move into the earth and continue drilling.

From the foregoing it will be readily evident that there has been provided an improved means and method for minimizing the manual exertion involved in drilling wells of the kind described.

I claim:

1. A well drilling assembly comprising a platform adapted to support a person thereon while drilling a well therebeneath, said platform having an opening for passing a drill stem therethrough, a clamp assembly carried by said platform, said clamp assembly including a mounting plate, first and second open jaws carried by said plate above said opening in opposed confronting relation, means supporting one of said jaws to move between advanced and retracted positions relative to the other of said jaws and to lock in said advanced position for clamping a pipestem between said jaws, and mounting means for supporting said plate to rotate around the axis of and with a pipe clamped between said jaws.

2. A well drilling assembly according to claim 1 in which said means for locking said one jaw in its advanced position comprises a readily trippable foot-operated means.

3. A well drilling assembly according to claim 1 in which said means for locking said one jaw in its advanced position comprises a connecting link, means supporting the link for movement between advanced and retracted positions, one end of said link being coupled to one jaw, an overcenter link, the other end of said first named link being pivotally coupled to an end of said over-center link, and a lever arm having a portion coupled to the other end of said over-center link for withdrawing said one jaw away from the other in response to lifting movement of said lever arm.

4. In a well drilling assembly of a type having a platform adapted to support a person while drilling a well therebeneath via an opening in the platform, a clamp assembly to be carried by said platform comprising a mounting plate, first and second open jaws carried by said plate in opposed confronting relation and adapted to be disposed above said opening, means supporting one of said jaws to move between advanced and retracted positions relative to the other and to lock in said advanced position for clamping a pipestem between said jaws, and mounting means for supporting said plate to rotate around the axis of and with a pipe clamped between said jaws.

5. A method of drilling a well through an access opening in a drill platform using a hand-held rotational power source for rotating drill stem sections coupled in tandem comprising the steps of coupling the power source to the upper end of a first section of drill stem, rotating said first section while supplying liquid under pressure therethrough to drill said first section into the ground, lifting said first section upwardly spaced from the bottom of the drilled hole, applying a clamp carried by the platform to grip said first section for holding said section in its lifted position, rotating said clamp and section together while supported by the platform, and supplying liquid via said section to flush the drilled hole.

6. A method according to claim 5 further including the steps of disconnecting said first section from said power source and connecting a second of said sections to the power source, connecting said second section to said first section, rotating said clamp and said first and second sections together while flushing liquid into and out of the drilled hole, and unclamping said clamp to permit said first and second sections to move into the earth and continue drilling.

* * * * *